United States Patent [19]

Seidel et al.

[11] Patent Number: 4,721,889

[45] Date of Patent: Jan. 26, 1988

[54] UNIFORM INSULATION APPLIED-B ION DIODE

[75] Inventors: David B. Seidel; Stephen A. Slutz, both of Albuquerque, N. Mex.

[73] Assignee: The United States of America as represented by the United States Department of Energy, Washington, D.C.

[21] Appl. No.: 850,455

[22] Filed: Apr. 11, 1986

[51] Int. Cl.[3] ..... H01J 7/24; H01J 27/00; H05H 7/04

[52] U.S. Cl. ..... 315/111.81; 315/344; 315/111.41; 313/231.31; 313/161; 250/423 R; 376/144; 376/107

[58] Field of Search ..... 315/111.81, 344, 337, 315/338, 111.41; 313/157, 161, 231.31; 250/423 R; 376/107, 128

[56] References Cited

U.S. PATENT DOCUMENTS 4,507,589 3/1985 Prono ..... 315/111.01

OTHER PUBLICATIONS

D. Johnson et al., "Anode Plasma Behavior in a Magnetically Insulated Ion Diode", J. Appl. Phys., 52(1), Jan. 81, pp. 168–174.

D. Johnson et al., "Electron and Ion Kinetics and Anode Plasma Formation in Two Applied-B Ion Diodes," J. Appl. Phys., 57(1), Feb. 85, pp. 794–805.

P. Dreike et al., "Selective Focusing of Different Ion Species Produced by Magnetically Insulated Ion Beam Diodes," J. Appl. Phys., 57(5), Mar. 85, pp. 1589–1591.

*Primary Examiner*—Saxfield Chatmon
*Assistant Examiner*—Mark R. Powell
*Attorney, Agent, or Firm*—George H. Libman; James H. Chafin; Judson R. Hightower

[57] ABSTRACT

An applied-B field extraction ion diode has uniform insulation over an anode surface for increased efficiency. When the uniform insulation is accomplished with anode coils, and a charge-exchange foil is properly placed, the ions may be focused at a point on the z axis.

7 Claims, 4 Drawing Figures

UNIFORM INSULATION APPLIED-B ION DIODE

The U.S. Government has rights in this invention pursuant to Contract No. DE-AC04-76DP00789 between the U.S. Department of Energy and AT&T Technologies, Inc.

BACKGROUND OF THE INVENTION

The instant invention relates to extraction applied-B ion diodes. More particularly, the instant invention relates to extraction applied-B ion diodes having uniformly-enhanced ion emission and focusing through charge-exchange.

There is currently considerable interest in using applied-B ion diodes as drivers for inertially confined thermal nuclear implosion devices. The radial geometry of barrel applied-B ion diodes accelerates ions in the radial direction when insulated by a $B_z$ magnetic field. Extractor ion diodes, which are insulated by a $B_r$ magnetic field rather than a $B_z$ magnetic field, accelerate ions in an axial direction rather than a radial direction. To date, these diodes have not been as successful as diodes having a radial geometry.

SUMMARY OF THE INVENTION

It is an object of this invention to provide an efficient extraction applied-B ion diode.

It is another object of this invention to provide an extraction applied-B ion diode having uniform magnetic insulation.

It is still another object of this invention to provide an extraction applied-B ion diode having uniform magnetic insulation and a charge-exchange foil to focus ions at a point.

Additional objects, advantages and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects in accordance with the purpose of the present invention, as embodied and broadly described herein, a conventional applied-B diode may comprise a ring cathode for generating electrons and a coaxial anode surface defining an annular disk extending from an inner edge to an outer edge, the cathode being axially spaced adjacent one of the anode edges. An applied-B field is provided parallel to the anode surface between the surface and the cathode. The improvement of this invention includes means for providing uniform insulation along the anode surface, this means satisfying the condition $$\Psi_a = G(V) r_a + \Psi_c$$

defined hereinafter. In a preferred embodiment, this means includes magnet coils within the anode, and the invention further includes a charge-exchange foil spaced between the anode surface and a fixed point and satisfying the condition $\Psi(\vec{r_a}) = [(q_b - q_a)/q_b]\Psi(\vec{r_f})$ defined hereinafter.

DETAILED DESCRIPTION OF THE INVENTION

Applicants explain the disparity in operating characteristics between radial geometry and extraction geometry diodes by considering the condition for magnetic insulation in terms of the magnetic stream function ($\Psi$). Through the principle of conservation of energy and angular canonical momentum, the condition:

$$\gamma^2(\beta_z^2 + \beta_r^2) = \left(\frac{ev}{mc^2} + 1\right)^2 - 1 - \left(\frac{\Delta\Psi}{r_a}\ \frac{e}{mc}\right)^2 \qquad \text{equation (I)}$$

can be derived for cylindrically symmetric systems, where $\Psi(\vec{r}) = rA_\theta(\vec{r})$ is the magnetic stream-function; $\Delta\Psi = \Psi(\vec{r_a}) - \Psi(\vec{r_c})$ is the difference between $\Psi$ at the anode and the cathode; V is the scalar anode potential; $r_a$ is the anode radius; m and $-e$ are the mass and charge of an electron, respectively; c is the speed of light in vacuum; $\gamma$ is the relativistic factor, and $\beta$ is the normalized velocity v/c.

An insulation condition is obtained from equation (I) for the extraction geometry by requiring that $\beta_z = 0$ at the anode. Clearly, from equation (I), electrons will penetrate the farthest into the gap when $\beta_r = 0$. Setting both $\beta_r$ and $\beta_z$ equal to zero reduces equation (I) to the expression:

$$\frac{\Delta\Psi}{r_a} = \frac{mc}{e}\left[\left(\frac{ev}{mc^2} + 1\right)^2 - 1\right]^{\frac{1}{2}} \equiv G(V) \qquad \text{equation (II)}$$

where G is a function of the voltage V. This condition applies for the radial geometry due to the symmetry of equation (I) with respect to $\beta_z$ and $\beta_r$. The expression in equation (II), in different forms, has been derived before, e.g., P. L. Dreike, Ph.D. Thesis, Cornell University, Ithaca, NY, August 1980. However, the full implication of equation (II) with respect to the insulation of applied-field ion diodes in both the radial ($\beta_z$) and extraction ($\beta_r$) geometries has not been realized in the prior art.

Standard radial (nonextraction) diode designs employ anodes made of aluminum, a good electrical conductor that excludes the applied-B field generated by field coils located within the cathode. Consequently, the anode surface is very nearly a surface of constant stream function wherein the stream function approaches zero. (Extraction geometry experiments have also used conducting anodes wherein the stream function along the anode surface is also very nearly zero.) In order to satisfy equation (II) from each cathode point to any point on the anode, the stream function at the anode must be:

$$\Psi_a = G(V) r_a + \Psi_c \qquad \text{equation (III)}$$

where $\Psi_c$ and $\Psi_a$ are the stream-function at the cathode and anode, respectively. Since the anode radius is nearly constant in a radial diode, equation (III) indicates that the anode should coincide with the surface of constant stream function. However, for an extraction geometry diode, this equation implies a significant variation of the stream-function along the anode.

Figure 1:
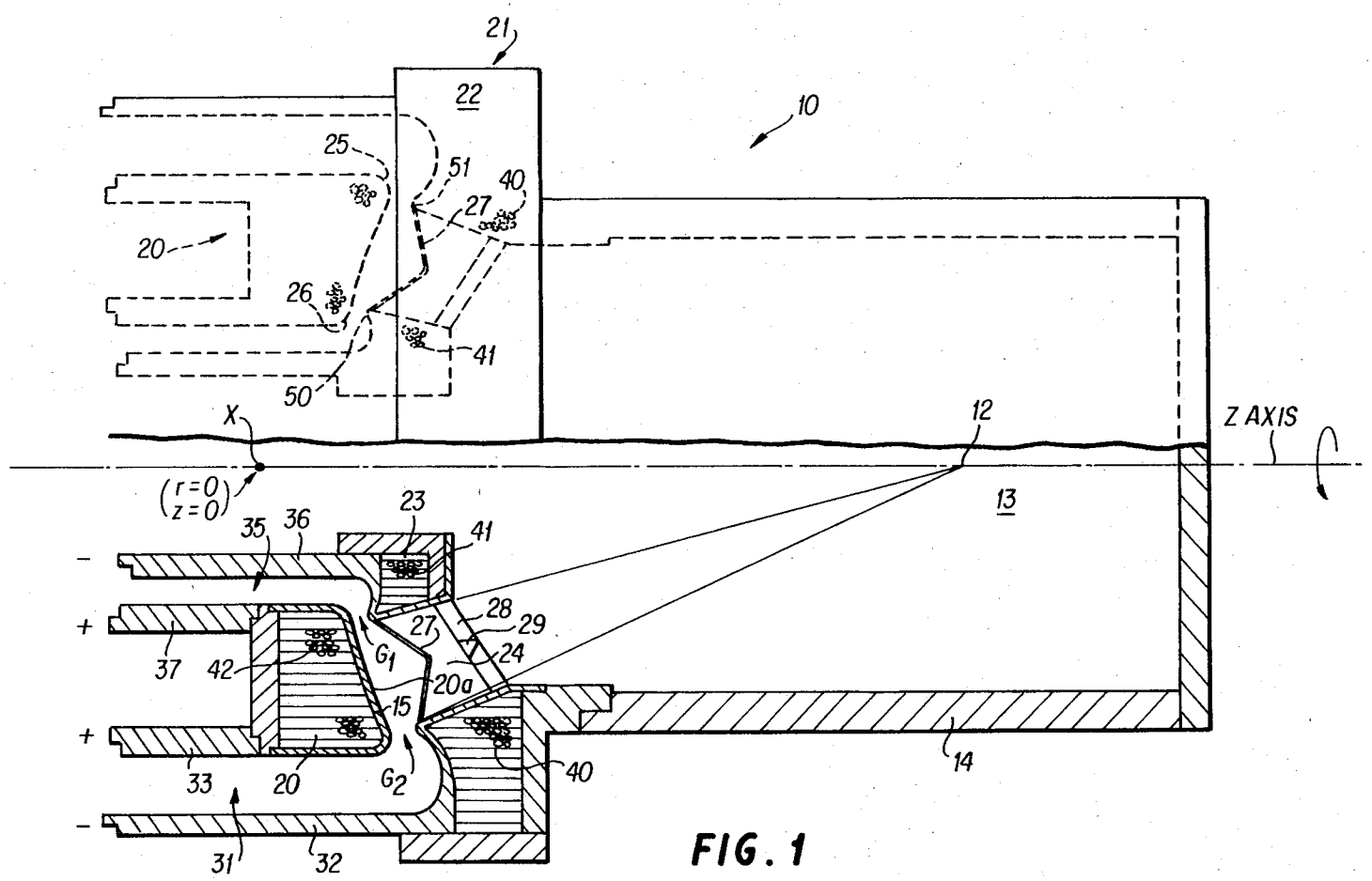
FIG. 1 is a partial cutaway view of a diode in accordance with a preferred embodiment of the invention.

FIG. 1 shows a first embodiment 10 of the extraction applied-B ion diode of the invention. To simplify the figure, construction details are shown only in the lower half of the figure and spacing relationships are identified on the upper half. It should be understood the diode is symmetrical about axis z.

Diode 10 includes an anode 20 having a surface 15 for releasing ions when subjected to the intense electric field of an applied-B ion diode. For an extraction diode, surface 15 conventionally is in the form of an annular disk extending from an inner edge 26 to an outer edge 25. The radius $r_a$ of anode 20 from axis z is less at inner edge 26 than at outer edge 25. Surface 15 may be formed of any known construction including those shown in D. J. Johnson, et al., "Anode plasma behavior in a magnetically insulated ion diode," J. Appl. Phys. 52(1), January 1981, pp. 168–174. As discussed hereinafter, surface 15 may include means for emitting lithium ions. However, any anode surface that emits ions in response to an applied-E field as is known in the art may be used in the practice of the invention.

Diode 10 also includes an annularly configured cathode 21 coaxial with, and spaced from, anode 20 along axis z. In this embodiment, cathode 21 comprises an outer annulus 21 and an inner annulus 23 having a space 24 therebetween. The portion of annulus 22 closest to anode 20 defines an outer cathode ring 51 spaced from outer edge 25 by gap G2. The portion of annulus 23 closest to anode 20 defines an inner cathode ring 50 spaced from inner edge 26 by gap G1.

Supporting struts 28 of a rigid material such as a metal are provided to hold inner annulus 23 in position relative to outer annulus 22. Each strut includes a conventional flux excluder 29, made of a highly conducting material such as aluminum, to contain the applied-B field to a minimum portion of ion drift.

As further shown in FIG. 1, diode 10 includes an outer coaxial transmission line 31 having an annular negative electrode 32 connected to outer annulus 22 and an annular conductor 33 connected to anode 20. In addition, an inner coaxial transmission line 34 includes an annular negative electrode 36 connected to inner annulus 23 and an annular conductor 37 connected to anode 20. Each of these transmission lines is self-magnetically insulated, i.e., vacuum breakdown of the line is prevented by the magnetic field of the wave propagating in the line.

Applied-B ion diode 10 also conventionally includes means for generating a magnetic field between anode surface 15 and cathode 21, the field being substantially parallel to anode surface 15. In the preferred embodiment disclosed, this magnetic field is provided by magnetic field coils 40 in cathode annulus 22, coils 41 in annulus 21, and coils 42 in anode 20.

The operation of the conventional applied-B ion diode is conventionally described in terms of the magnetic field as follows: Coils 40 and 41 are pulsed, producing a magnetic field parallel to anode 15 and spanning space 24 between anode 15 and cathode 20. (The field lines, of course, form a loop around the magnet coils, the remaining field lines crossing space 24 on the other side of the coils from anode 15.) Eddy currents confine the magnetic field outside the anode surface.

A very high voltage (e.g. 1 MV) pulse is applied between the anode and cathode about 100 $\mu$s after the magnetic field was pulsed. After the voltage across gaps G1 and G2 reaches a few hundred kV, a cathode plasma forms and emits electrons from rings 50 and 51 that stream along the magnetic field lines. The flow of electrons forms a virtual cathode that attracts ion from anode surface 15.

The production of ions has been shown to be quite efficient for barrel geometry ion diodes having a generally cylindrical anode surface of constant radius for directing ions radially inward towards a center axis. However, prior to this invention, extraction geometry applied-B ion diodes have not been too efficient as they typically exhibit electron loss at the outer edges of the anode.

As stated above, the problem recognized and solved by this invention is the desirability of maintaining uniform insulation in the applied-B field between cathode rings 50, 51 and anode surface 15. Uniform insulation is not a problem with a barrel diode where the anode surface is nearly a constant radius from axis z (where the target is located). However, the annular disk that forms anode surface 15 for an extraction diode has a constantly changing radius between inner edge 26 and outer edge 25. Applicants have determined that the changing magnetic insulation resulting from this changing radius must be corrected before uniform insulation is attained.

Figure 2:
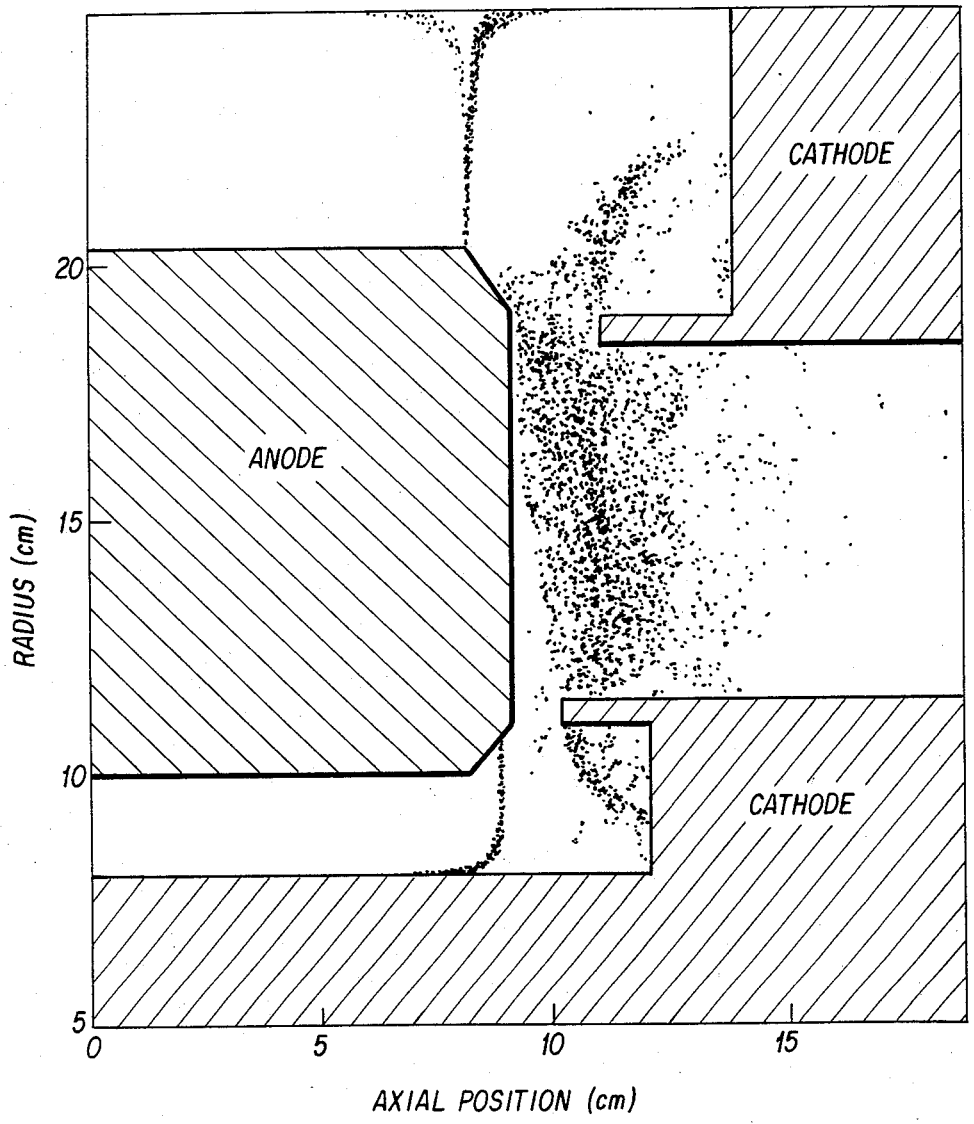
FIG. 2 PRIOR ART
FIG. 2 is a simulation of electron flow in a diode without uniform insulation.

Applied-B ion diodes are typically operated near the critical insulating field to take advantage of the resulting enhancement of the ion emission current density over the Child-Langmuir monopolar value (see K. D. Bergeron, *Appl. Phys. Lett.* 28, 306 (1976)). The enhancement is the result of electron space-charge within the accelerating gap. The insulation must be quite uniform over the anode surface or the ion current density will vary considerably over the anode surface. FIG. 2 shows a computer simulation of electron current density, using an electromagnetic Particle-In-Cell code called MAGIC, for a prior art extraction diode that does not have uniform magnetic insulation; i.e., a diode constructed such that equation (II) is not satisfied. The distance between the anode and the electrons is seen to vary with the radius of the anode from axis z (the centerline). This variation of current density results in either much higher impedance than expected, since portions of the anode do not emit ions in the fully-enhanced mode, or low efficiency, since portions of the diode are not adequately insulated.

An understanding of the magnetic stream function of an extraction diode has taught applicants two techniques for providing uniform insulation of an extraction diode. The conceptually simple approach is to overinsulate diode 10; i.e., make the applied-B field very large so that ion emission is not significantly enhanced above the Child-Langmuir value over surface 15 of anode 20. Practically, this approach is not possible because of limitations in constructing large magnets and small accelerating gaps.

The practical approach is recognizing that the magnetic field must be applied to the extraction diode so that equation (II) is satisfied. The geometry of the magnetic field in diode 10 may be designed through the use of additional magnets so that equation (II) is satisfied at all points along anode surface 15. The design is readily attained using a static magnetic field solver code such as ATHETA (J. Quintenz et al., Sandia Report SAND84-1336, 1984).

In the embodiment of FIG. 1, coils 40, 41, and 42 produce a magnetic field which satisfies equation (III). The placement of the coils is an iterative process. First, anode coils are placed in a computer model of the diode and a current value assigned to them. Then the ATHETA code is used to simulate the magnetic field. The coils or current is subsequently varied and the code run until equation (III) is satisfied. In practice, the coils could be distinct coils, each with a separate power supply, or a continuous winding having different numbers of coils at different locations. This type iterative calculation of magnetic fields using a static magnetic field solver such as ATHETA is well known to those skilled in the applied-B ion diode art.

Figure 3:
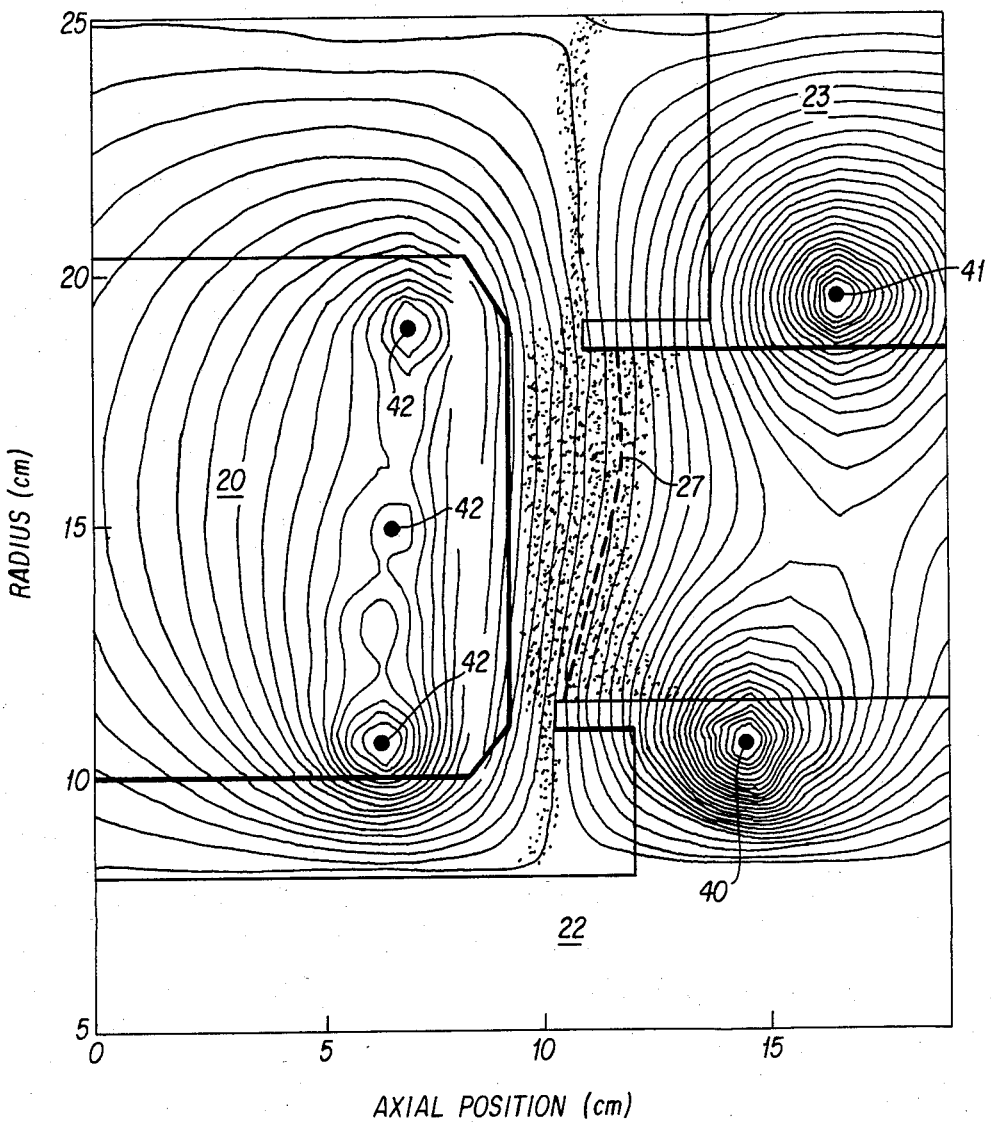
FIG. 3 is a simulation of electron flow in a diode with uniform insulation and magnetic flux showing the placement of the charge-exchange foil in the preferred embodiment.

FIG. 3 shows a simulation of an extraction diode according to this invention using an electromagnetic Particle-In-Cell code called MAGIC. A voltage pulse that ramped to a constant 25 MV in 1 ns was applied to both inner and outer transmission lines 35 and 31. The Figure shows the electron sheath 3.6 ns into the simulation to be reasonably uniform over the entire anode surface, indicating that uniform insulation has been achieved by satisfying equation (II).

Theoretically, the actual magnetic field will vary slightly from that provided by ATHETA because the computer code assumes materials have either zero or infinite conductivity, e.g., the anode has zero conductivity while the flux excluders have infinite conductivity. Practically, a good conductor is a substance having a conductivity large enough that the magnetic diffusion time is long compared to the time scale of interest. In this invention, the applied-B field is applied for 100's of microseconds, so materials such as plastic or stainless steel with thicknesses up to 2.5 mm are poor conductors while materials such as aluminum are good conductors. A magnetic diffusion code (such as TRIDIF, J. R. Freeman, J. Comp. Phys. 41, 142 (1981)) can be used to determine the effect of finite conductivities on the applied-B field. Some applications of extractor diodes require the ion to be focused along axis z. Although a uniformly-enhanced applied-B extraction diode will have maximum efficiency of ion output, the non-uniform magnetic field will introduce a variation in the canonical angular momenta of the ions as a function of anode emission position. The effect of this variation is that the ions cannot be focused on a single point along axis z unless their momenta is changed.

Drieke et al teach that a mylar foil will strip light ions from a 30 MV Lithium atom, leaving $Li^{+3}$ in a barrel diode. These ions can be focused to some extent by adjusting the magnetic field. Other ions also can be used as long as they are accelerated to sufficient energy for the charge-stripping reaction to occur.

Applicants have expanded the teaching of Drieke et al. so that a properly placed foil will focus the uniform output of their extraction diode to a point on axis z. In particular, since a 2 micron mylar film is thick enough to fully ionize lithium ions, and consequently change their canonical angular momentum, by locating this foil appropriately with respect to the lines of magnetic flux the following relation can be satisfied:

$$\Psi(\vec{r_a}) = [(q_b - q_a)/q_b]\Psi(\vec{r_f}) \qquad \text{equation (IV)}$$

where $q_b$ is the ion charge before charge exchange in the foil, $q_a$ is the ion charge after passing through the foil, $\vec{r_a}$ is the emission point of the ion and $\vec{r_f}$ is the point of penetration through the foil.

FIG. 3 shows a possible extraction diode design in which the foil position has been calculated from equation (IV) and the magnetic field lines produced by the ATHETA code.

It should be noted that it is possible to satisfy equation (II) without using anode field coils by using a combination of "good" and "poor" conductors to construct the anode. However, such an anode design cannot also satisfy equation (IV) (permitting ion focusing) since the stream-function must change sign between the anode emission site and the charge-exchange foil.

Figure 4:
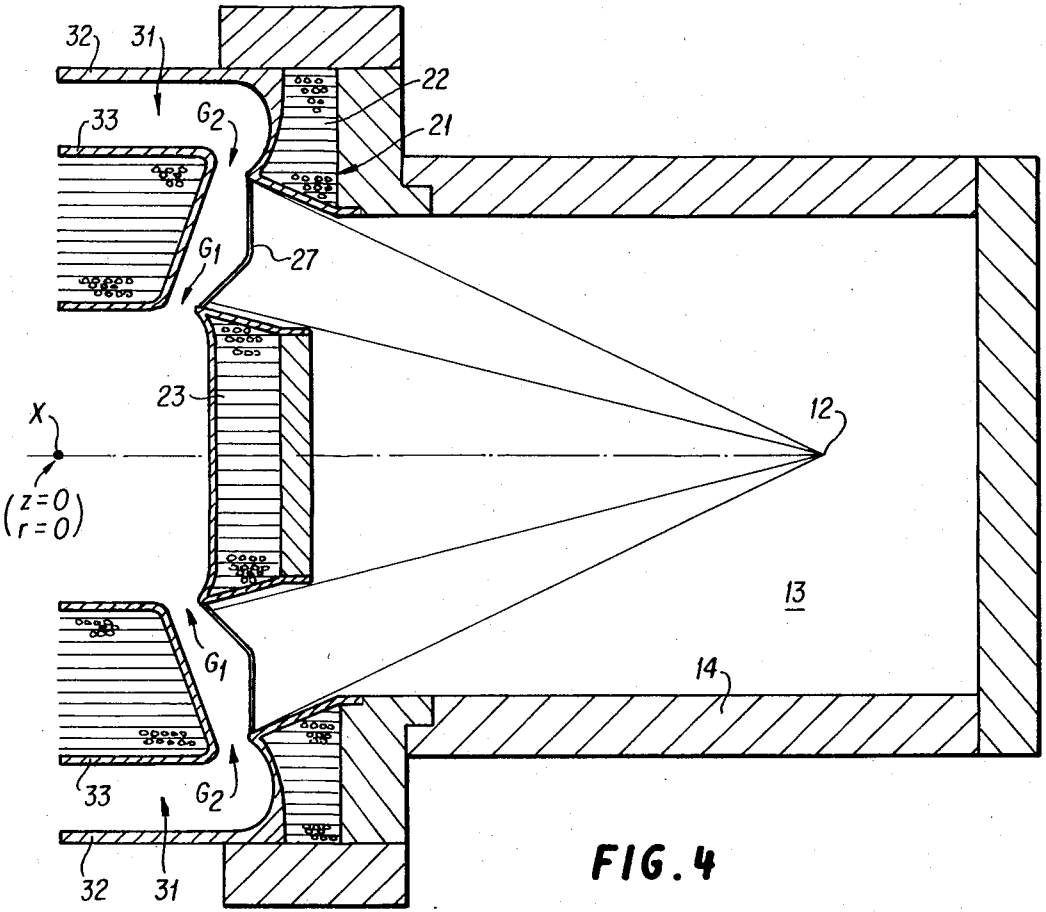
FIG. 4 is a cutaway of a second embodiment of the invention.

FIG. 4 shows a sectional view of a second embodiment of the invention where inner annulus 23 of the first embodiment has been changed to a disk 23*a*, eliminating the inner transmission line 35. Although not shown, inner line 35 could have been maintained and outer transmission line 31 eliminated. The embodiment of FIG. 1 is the preferred embodiment.

A typical embodiment according to FIG. 1 is dimensioned approximately as follows:

| | |
|---|---|
| diameter of gas cell 14 | 18 cm |
| length of gas cell 14 | 45 cm |
| distance from cathode 23 to focal point | 35 cm |
| radius of outer edge 25 | 20 cm |
| radius of inner edge 26 | 10 cm |
| radius of ring 50 | 10 cm |
| minimum radius of cathode 23 | 5 cm |
| width of space 24 | 7.5 cm |
| width of gap G1 | 1 cm |
| width of gap G2 | 1.5 cm |

In conclusion, applicants have invented an extraction applied-B diode that maximizes ion output by satisfying the conditions of equation (I) to provide uniform magnetic insulation. Furthermore, applicants have provided a properly placed foil to change the angular momentum of the their ions to enable the ions to be focused at a point along the centerline of their diode.

The particular sizes and devices discussed above are cited merely to illustrate particular embodiments of the invention. It is contemplated that the use of this invention may involve different materials, shapes and sizes as long as the principle, providing uniform insulation on an extraction applied-B ion diode, and focusing the ions to a point, is followed. A device so constructed will provide an efficient source of ions at a remote location. It is intended that the scope of the invention be defined by the claims appended hereto.

We claim:

1. In an extraction applied-B ion diode having:

cathode means for generating electrons, said cathode means comprising a ring symmetrically arranged about a center line;

anode surface means for releasing ions, said anode surface means comprising an annular disk extending from an inner edge to an outer edge coaxial with said cathode means, the radius from said centerline to said inner edge being less than the radius from said centerline to said outer edge, said cathode means being axially spaced from said anode means adjacent one of said edges;

applied-B field means for providing a magnetic field parallel to said anode surface and between said anode surface and said cathode, wherein the improvement comprises:

means for providing uniform insulation along said anode, said means satisfying the condition: $\Psi_a = G(V)r_a + \Psi_c$ wherein $\Psi_a$ and $\Psi_c$ are the magnetic stream functions at the anode and cathode, respectively, and $r_a$ is the radius of the anode and $$\frac{\Delta\Psi}{r_a} = \frac{mc}{e}\left[\left(\frac{e}{mc^2}V + 1\right)^2 - 1\right]^{\frac{1}{2}} \equiv G(V)$$

where $\phi_a$ is the scalar anode potential, m and $-e$ are, respectively, the mass and charge of an electron, and c is the speed of light in vacuum.

2. The extraction applied-B ion diode of claim 1 further comprising means for focusing said ions at a point.

3. The extraction applied-B ion diode of claim 2 wherein said point is along said center line.

4. The extraction applied-B ion diode of claim 3 wherein said means for focusing comprises a foil spaced between said anode and said point to provide a charge-exchange reaction for the ions, said foil beingpositioned to satisfy the relation:

$$\Psi(\vec{r_a}) = [(q_b - q_a)/q_b]\Psi(\vec{r_f})$$

where $q_b$ is the ion charge before charge exchange in said foil, $q_a$ is the ion charge after passing through said foil, $\vec{r_a}$ is the emission point of the ion and $\vec{r_f}$ is the point of penetration through said foil.

5. The extraction applied-B ion diode of claim 4 wherein said anode surface means comprises a portion of an annular anode, said cathode ring comprises a portion of an annular cathode, and said means for providing uniform insulation comprises magnetic field coils located within said annular anode and said annular cathode.

6. The extraction applied-B ion diode of claim 1 wherein said cathode means comprises a second ring symmetrically arranged about said center line and spaced from said anode means adjacent the other of said edges.

7. The extraction applied-B ion diode of claim 6 further comprising means for focusing said ions at a point along said center line, said means comprising a foil spaced between said cathode rings to provide a charge-exchange reaction for the ions, said foil being positioned to satisfy the relation: $\Psi(\vec{r_a}) = [(q_b - q_a)/q_b]\Psi(\vec{r_f})$ where $q_b$ is the ion charge before charge exchange in said foil, $q_a$ is the ion charge after passing through said foil, $r_a$ is the emission point of the ion and $r_f$ is the point of penetration through said foil.

* * * * *